US010745951B2

(12) United States Patent
Wunderle et al.

(10) Patent No.: US 10,745,951 B2
(45) Date of Patent: Aug. 18, 2020

(54) HINGE COVER

(71) Applicant: BUMPERHERO LLC, Mt. Prospect, IL (US)

(72) Inventors: Christopher M. Wunderle, Mt. Prospect, IL (US); David W. Wunderle, Arlington Heights, IL (US)

(73) Assignee: BUMPERHERO LLC, Mt. Prospect, IL (US)

( * ) Notice: Subject to any disclaimer, the term of this patent is extended or adjusted under 35 U.S.C. 154(b) by 162 days.

(21) Appl. No.: 15/955,311

(22) Filed: Apr. 17, 2018

(65) Prior Publication Data

US 2018/0305963 A1 Oct. 25, 2018

Related U.S. Application Data

(60) Provisional application No. 62/489,561, filed on Apr. 25, 2017.

(51) Int. Cl.
*E05D 11/00* (2006.01)
*E05D 15/24* (2006.01)

(52) U.S. Cl.
CPC ..... *E05D 11/0054* (2013.01); *E05D 15/242* (2013.01); *E05Y 2800/344* (2013.01); *E05Y 2800/40* (2013.01); *E05Y 2900/106* (2013.01)

(58) Field of Classification Search
CPC ..... E05D 11/0054
See application file for complete search history.

(56) References Cited

U.S. PATENT DOCUMENTS 1,268,104 A 6/1918 Flick et al.
1,626,844 A 5/1927 Kuhn
(Continued)

FOREIGN PATENT DOCUMENTS

GB 2082671 A 3/1982

OTHER PUBLICATIONS

BumperPal Protective Garage Door Pads, <https://www.amazon.com/dp/B008NQM0R4>, downloaded from the Internet Oct. 3, 2017.

(Continued)

*Primary Examiner* — Victor D Batson
*Assistant Examiner* — Matthew J Sullivan
(74) *Attorney, Agent, or Firm* — Jansson Munger McKinley & Kirby Ltd.

(57) ABSTRACT

A hinge cover for preventing damage to a vehicle or other object caused by contact with one or more hinge of a vertically opening door. Hinges which may be covered with a hinge cover may include leaves connected together by an axial barrel with opposite ends defining openings. A hinge cover may comprise a generally wedge-shaped body and an axial connector removably insertable in a respective barrel end opening to removably attach the hinge cover to the hinge. The body may include a downwardly-sloping ramp and a pair of opposed sidewalls which receive the barrel therebetween. In embodiments, an axial connector comprises a pair of opposed coaxial tabs extending from a respective sidewall which can each be inserted into a respective end opening of the barrel to removably attach the hinge cover to the hinge. The hinge cover shields a vehicle or other object in the path of the hinge from direct or glancing damaging contact by the hinge.

19 Claims, 9 Drawing Sheets

(56) References Cited

U.S. PATENT DOCUMENTS 2,504,635 A 4/1950 Bradley
2,641,792 A 6/1953 Peeler
2,772,064 A 11/1956 Cole
2,910,741 A 11/1959 Dettman
3,319,697 A 5/1967 Krohn
3,376,913 A 4/1968 Clapsaddle
3,846,868 A 11/1974 Brydolf
4,344,253 A 8/1982 Stiles
4,856,141 A 8/1989 Sassenberg
5,001,862 A 3/1991 Albenda
5,002,114 A 3/1991 Hormann
5,056,191 A 10/1991 Love
5,056,192 A 10/1991 Grass
5,362,131 A 11/1994 Susko et al.
5,490,306 A 2/1996 Floyd et al.
5,618,060 A * 4/1997 Warren ..... B62J 15/00 16/250
5,881,431 A * 3/1999 Pieper, II ..... E05D 11/06 16/374
6,434,888 B1 8/2002 Shaw et al.
6,527,036 B1 3/2003 Welsh
6,698,492 B2 3/2004 Lewis
6,721,992 B2 * 4/2004 Cotton ..... E05D 11/0054 16/250
6,745,435 B2 6/2004 Bowers
6,883,205 B2 * 4/2005 Martinez-Munoz ..... E05D 11/0054 16/250
6,935,400 B1 8/2005 Welsh
7,178,197 B2 * 2/2007 Verheye, Sr. ..... E05D 11/0054 16/250
7,673,373 B2 * 3/2010 Chang ..... E05D 5/0246 16/250
7,841,573 B1 11/2010 Block
8,011,064 B2 * 9/2011 Leimkuehler ..... E05D 11/0054 16/251
8,307,509 B2 * 11/2012 Schau ..... E05D 3/122 16/250
8,585,167 B2 * 11/2013 Takahashi ..... E05D 11/0054 16/250
8,978,205 B2 * 3/2015 Kim ..... E05D 11/0054 16/251
9,708,841 B1 * 7/2017 Kar ..... E05D 11/0054
2004/0007334 A1 1/2004 Lewis, Jr.
2005/0081333 A1 4/2005 Emerson et al.
2005/0269043 A1 12/2005 Welsh
2008/0276421 A1 11/2008 Vanderpan
2008/0295286 A1 * 12/2008 Falato ..... E05D 11/0054 16/250
2008/0313856 A1 12/2008 Thompson et al.
2010/0088850 A1 * 4/2010 Dringenberg ..... E05D 11/0054 16/251
2010/0139039 A1 * 6/2010 Balbo Di Vinadio ..... E05D 7/0045 16/235
2015/0074944 A1 * 3/2015 Tung ..... E05D 11/0054 16/251
2015/0107052 A1 * 4/2015 Talpe ..... E05D 3/02 16/251

OTHER PUBLICATIONS

Heavy Duty 14 Guage Garage Door Hinges, <https://store.preferreddoorservice.com/garage-door-hinges-heavy-duty-14-gauge-1-6>, downloaded from the internet Oct. 3, 2017.

* cited by examiner

HINGE COVER

RELATED APPLICATION

This application claims the benefit of U.S. Provisional Patent Application Ser. No. 62/489,561 filed Apr. 25, 2017. The entire content of Patent Application Ser. No. 62/489,561 is incorporated herein by reference for continuity of disclosure.

FIELD

The invention relates to protective covers for vertical door hinges, and more particularly, to hinge covers which protect vehicles and other objects from potentially-damaging contact by a vertical door hinge.

BACKGROUND

Vertical doors, also known as overhead or garage doors, typically comprise an articulated door made up of an assembly of several joined-together panels or sections. Each panel is typically joined together one-above-the other by means of one or more hinge. The door is typically raised or lowered by means of a system of rollers and tracks. Rollers typically extend from outboard hinges on opposite ends of each panel. The rollers travel in tracks provided on opposite sides of the door. The tracks typically include a vertical section and a horizontal section which is typically at a 90° angle to the vertical section. A curved track section connects the vertical and horizontal sections. The hinges enable adjacent panels to pivot with respect to the other so that the panels can follow the tracks as the door is raised or lowered along the tracks.

Vertical doors can be raised or lowered manually or by means of an automatic door opener device. As is known, a typical automatic door opener includes an electric motor (e.g., ⅓ to ½ horsepower) which raises and, alternatively, lowers the vertical door by means of a chain or belt drive acting on a link attached to the vertical door.

A problem with existing vertical doors is that the hinges are almost always on the inside of the door and can contact and damage a vehicle parked in the garage as the door is raised or lowered. This can be a particular problem when using an automatic door opener because the user is typically spaced from the door and is unable to see whether the vehicle or other object is in too close of a proximity to the path of the hinge during door movement. Depending on the size and configuration of the hinges, the hinges can project away, or inward, from the inside surface of the panels anywhere from about 0.075 inch to 3 or more inches. And, vertical door hinges are robust and are frequently made of sturdy 11 to 18 gauge galvanized steel so they have the potential to damage anything in their path.

Should a vehicle be parked within a garage or other space in a proximity too close to the vertical door, it is possible that the bumper of the vehicle or another vehicle surface, could be in the path of the hinges extending out from the panels. Any contact between the robust hinge and the vehicle as the door is raised or lowered could scrape, gouge, or otherwise severely damage the vehicle. Damage could also occur to the vehicle should a moving vehicle strike a stationary hinge of a non-moving door.

Efforts have been made to solve the foregoing problems associated with damage that can be caused by vertical door hinges as described, for example, in U.S. Pat. No. 7,187,197 (Verhey, Sr.) and U.S. Pat. No. 9,708,841 (Kar). However, the hinge covers proposed in those documents have certain important disadvantages. The Verhey cover disadvantageously requires a labor-intensive installation process requiring disassembly of the door hinges from the door which many consumers may not wish to do, or be capable of doing. The Kar hinge cover has attachment structure which is difficult and uneconomical to manufacture and limits the protective capability of the cover. It would be an advance in the art to provide a hinge cover which would protect a vehicle or other object from contact with, and damage by, a vertical door hinge, which would be easy and simple to attach to the hinge, which would attach reliably to the hinge, and which would be easy and simple to manufacture.

SUMMARY

Hinge covers which are removably attachable to a hinge for a vertical door are described herein. Hinges which may be covered by hinge covers of the types described herein may include leaves connected together by an axial barrel. The barrel may have a length dimension with opposite ends defining openings.

In embodiments, a hinge cover may have a generally wedge-shaped body and an axial connector removably insertable in a respective barrel end opening. Insertion of the axial connector may removably attach the hinge cover to the hinge.

The wedge-shaped body may include a downwardly-sloping ramp and may have a pair of opposed sidewalls. The ramp may slope downwardly from an upper end of the hinge cover toward a lower end of the hinge cover. In embodiments, the ramp may have a smooth outer surface. The sidewalls may extend in the same direction away from the ramp. The sidewalls may have opposed inner surfaces spaced from one another sufficiently to receive the barrel therebetween. The inner surfaces of the sidewalls may be proximate a respective end of the barrel.

In embodiments, the body of the hinge cover may comprise a unitary element of polymeric material. The sidewalls of such body may be flexible. The axial connector may comprise a pair of inwardly-facing coaxial tabs in the body. A tab of the axial connector may be on each of the opposed inner sidewall surfaces extending away from the respective sidewall inner surface. In such embodiments, the sidewalls may be flexed outward to enable insertion of the tabs in a respective barrel end opening to attach the hinge cover to the hinge. Each sidewall of the hinge cover may be spaced from the other sufficiently to fit over the opposite ends of the barrel which facilitates insertion of a tab into a respective barrel end opening.

In certain embodiments, each sidewall may have an outer edge and the edge may include a curvature or radius which is substantially identical for each sidewall. The curvature or radius of the edges enables the hinge cover to rotate upward about the coaxial tabs during glancing contact with a vehicle or other object to minimize possible damage.

By way of non-limiting example, the polymeric material used to manufacture hinge covers suitable for applications of the types described herein may have a memory which allows the hinge cover to flex and return to its original configuration. A non-limiting finished-form embodiment of a hinge cover useful for certain applications may have a durometer of about 40 to about 80 on the Shore A scale while other embodiments may have a durometer of about 60 to about 70 on the Shore A scale.

Other aspects and examples of the hinge cover and invention are described in the disclosure which follows.

BRIEF DESCRIPTION OF THE DRAWINGS

Exemplary hinge covers may be understood by reference to the following description taken in conjunction with the accompanying drawings, in which like reference numerals identify like elements throughout the different views. The drawings are not necessarily to scale, emphasis instead being placed upon illustrating the principles of the invention. The drawings depict only embodiments of the invention and are not therefore to be considered as limiting the scope of the invention. In the accompanying drawings.

DETAILED DESCRIPTION

Figure 1:
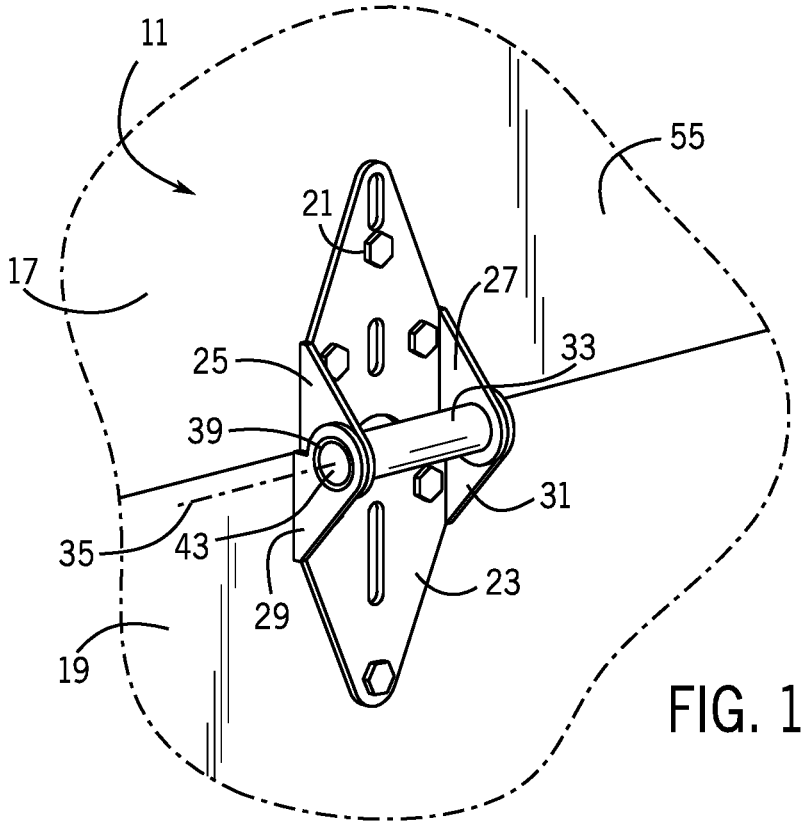
FIG. 1 is a perspective view of a garage door hinge to which a hinge cover according to the invention may be removably attached.
Figure 2:
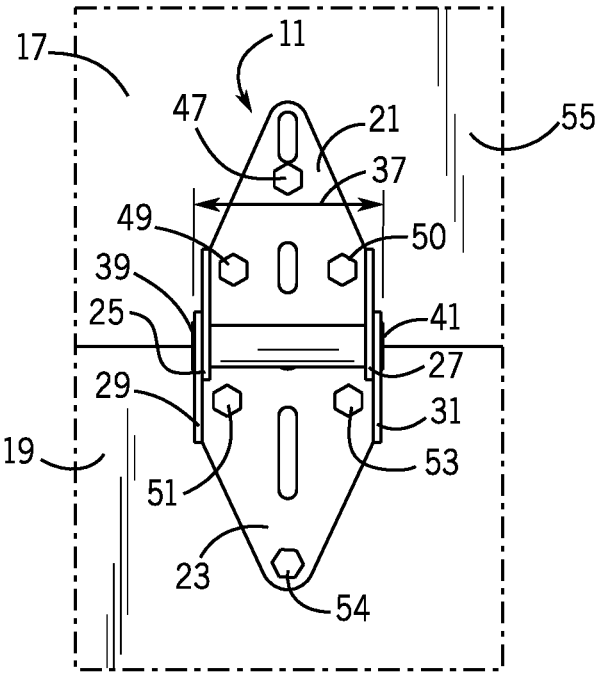
FIG. 2 is a front elevation view of the hinge of FIG. 1.
Figure 3:
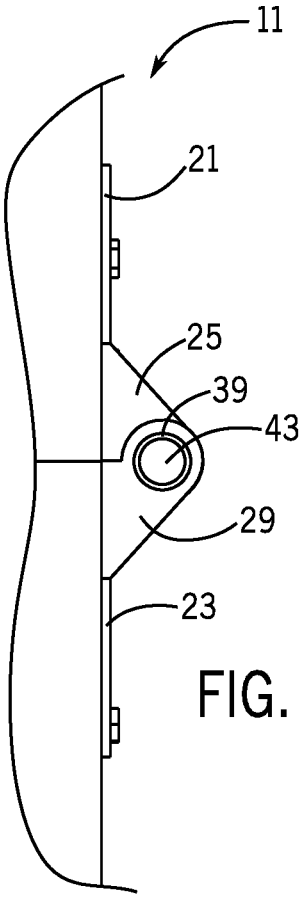
FIG. 3 is a side elevation view of the hinge of FIGS. 1 and 2.
Figure 4:
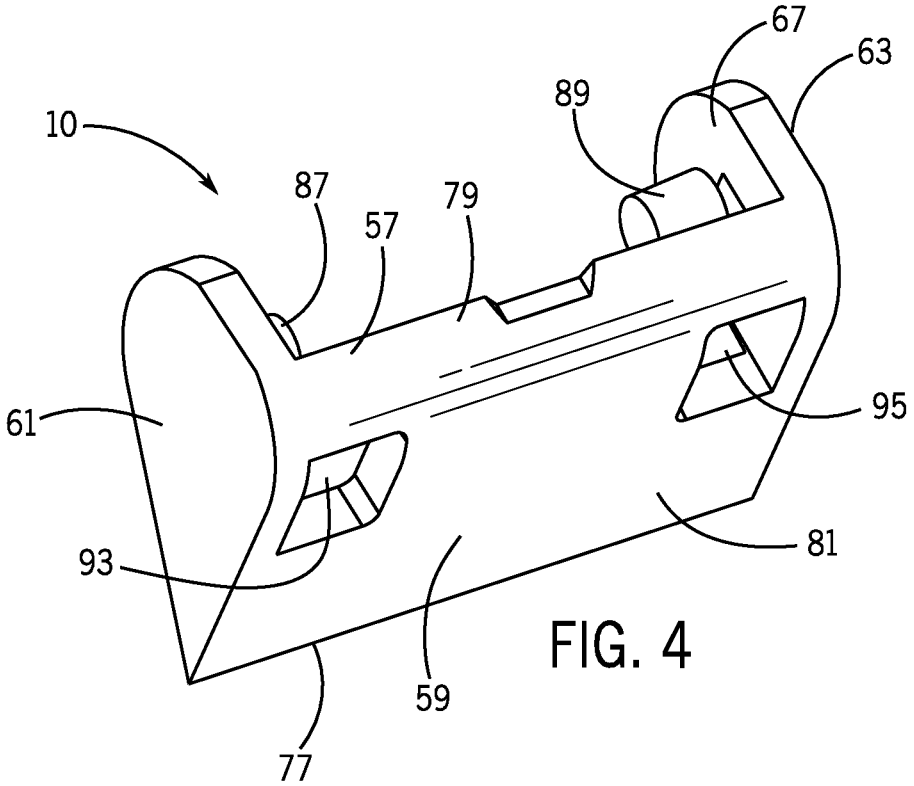
FIG. 4 is a perspective view of an embodiment of a hinge cover according to the invention.
Figure 5:
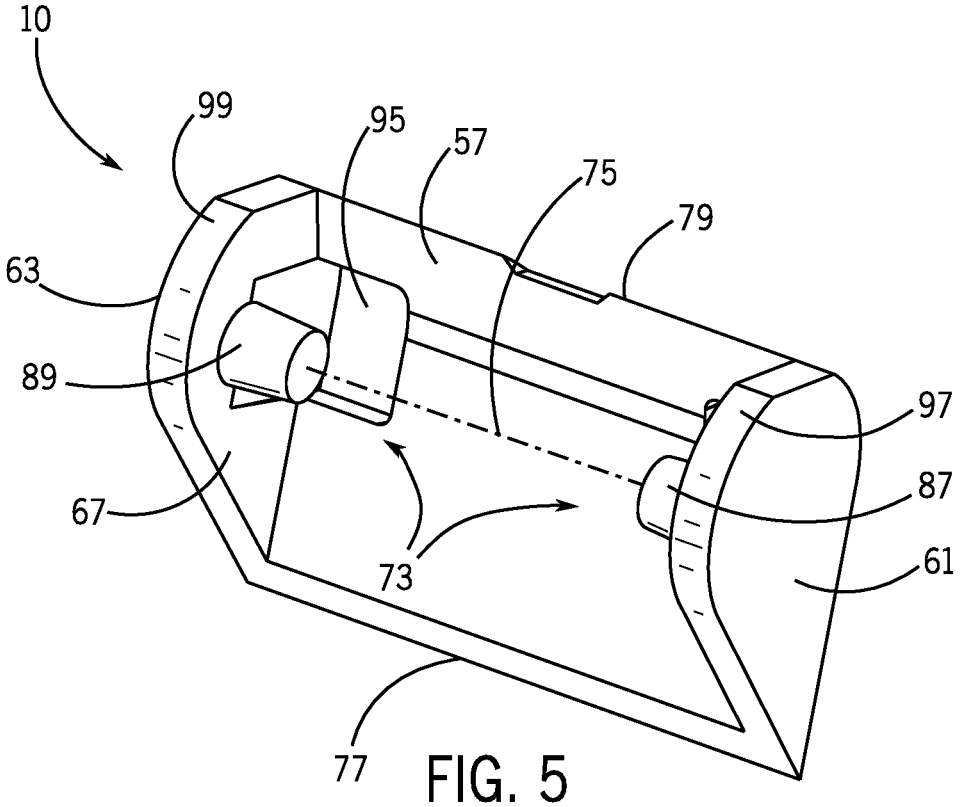
FIG. 5 is a further perspective view of the hinge cover of FIG. 4.
Figure 6:
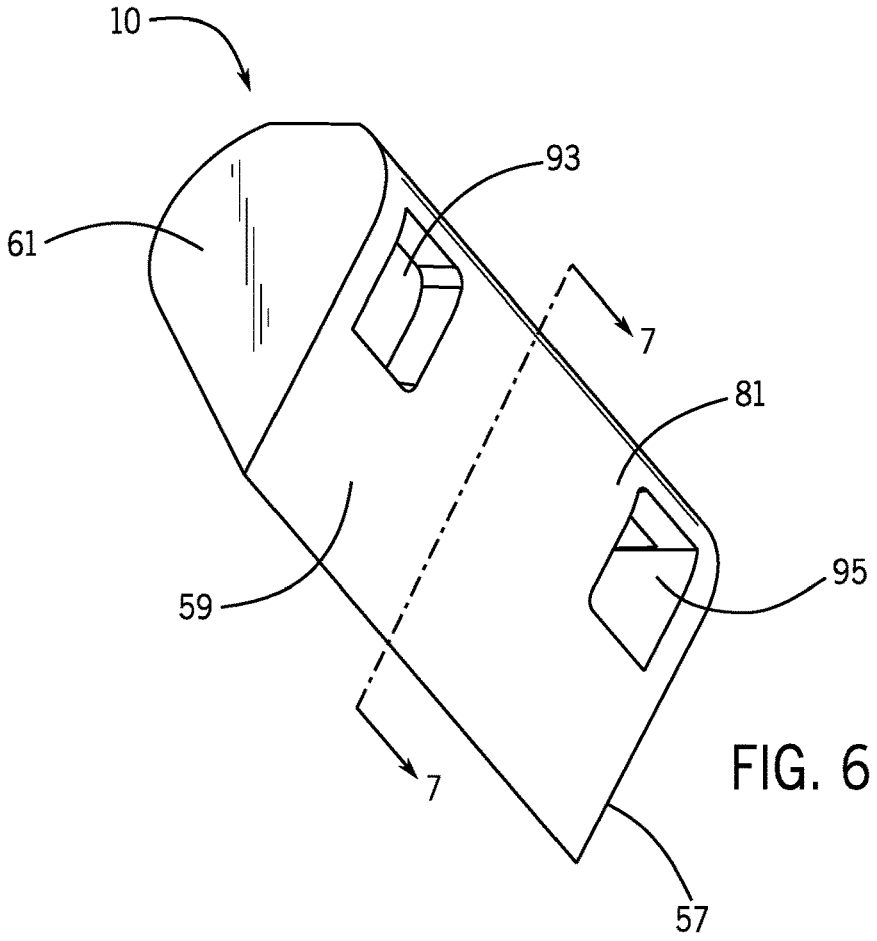
FIG. 6 is a top side view of the hinge cover of FIG. 4.
Figure 7:
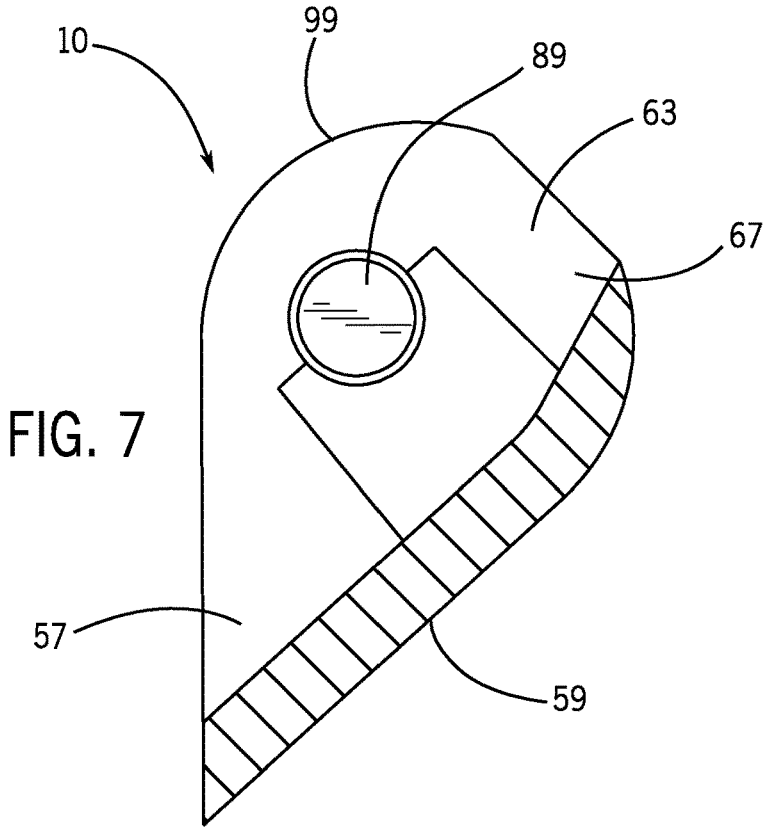
FIG. 7 is a section view taken along section 7-7 of FIG. 6.
Figure 8:
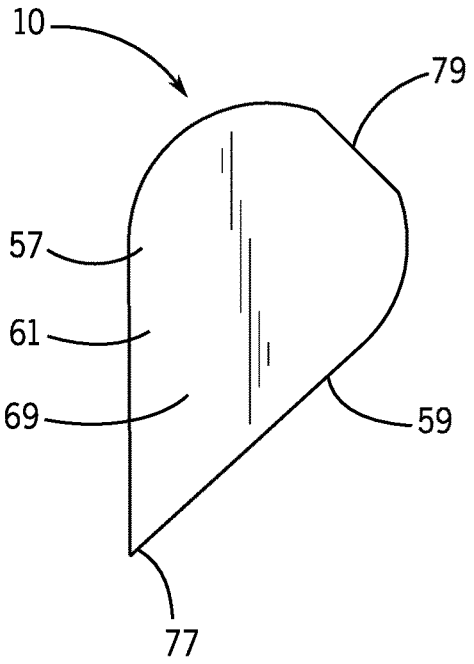
FIG. 8 is a left side view of the hinge cover of FIG. 4, it being understood that the right side view may be a mirror image of the left side view.
Figure 9:
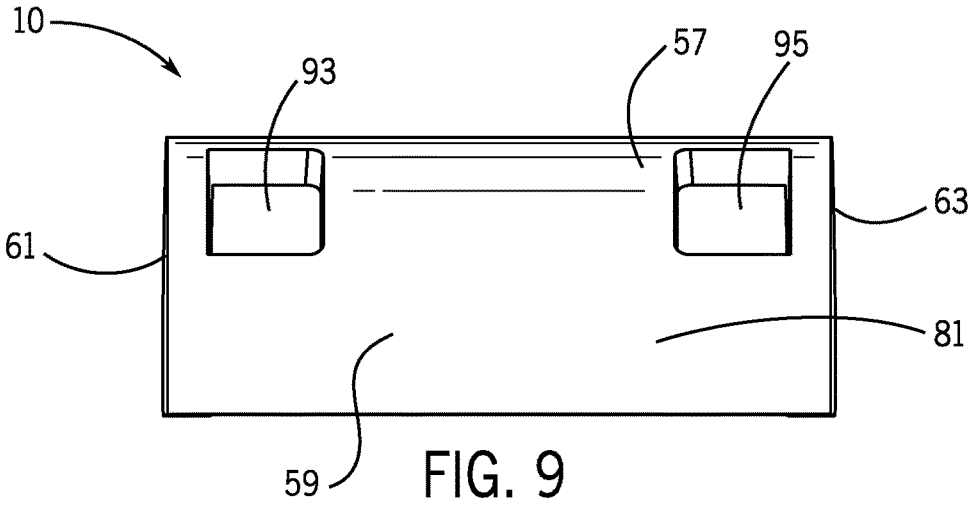
FIG. 9 is an elevation view taken toward a bottom end of the hinge cover of FIG. 4.
Figure 10:
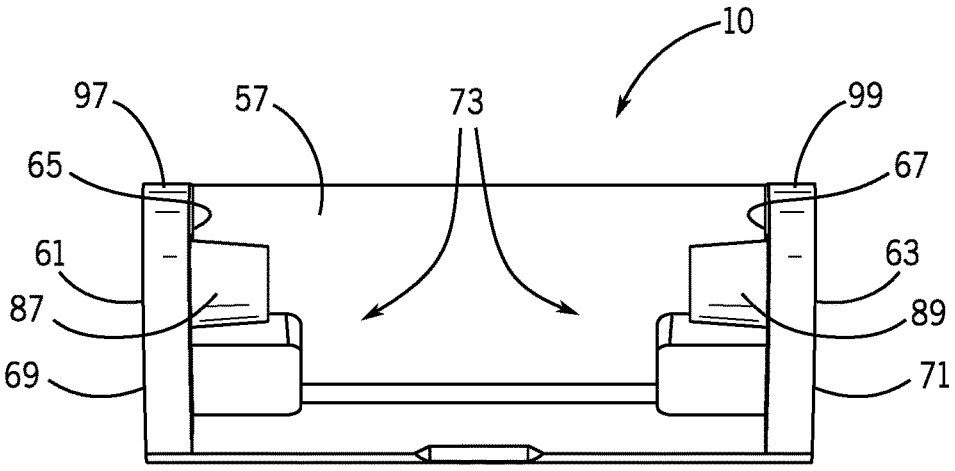
FIG. 10 is an elevation view taken toward a top end of the hinge cover of FIG. 4.

Referring to FIGS. 1-16C, one example of a hinge cover 10 according to the invention is illustrated. Hinge cover 10 may be removably attached to a hinge 11 of the type used with an articulated vertical door 13 to connect adjacent vertical door panels 15, 17, 19.

An example of a hinge 11 used to join panels 15, 16, 17 of a vertical door 13 and capable of being covered with a hinge cover 10 will now be described in connection with FIGS. 1-3 and 11. Hinge 11 may consist of a pair of leaves 21, 23 with leaf 21 being considered an "upper" leaf and leaf 23 being considered a "lower" leaf in the examples of FIGS. 1-3. Each leaf 21, 23 may include a pair of opposed gussets 25, 27 and 29, 31 extending away from a plane of the respective leaf 21, 23 at about a 90° angle. A cylindrical barrel 33 may be permanently in place between gussets 29, 31 of leaf 23 and through co-axial openings (not shown) in gussets 25, 27 of leaf 21 preventing separation of leaves 21, 23 and allowing leaves 21, 23 to rotate about an axis 35 (FIG. 11) defined by barrel 33. Barrel 33 may have a length dimension 37 and opposite ends 39, 41 defining openings 43, 45.

Leaves 21, 23 may include fasteners 47, 49, 50, 51, 53, 54 (e.g., a lag bolt) inserted through corresponding openings (hidden beneath the fasteners) in leaves 21, 23 to secure hinge 11 to an inside surface 55 of adjacent panels 15, 17, 19 of vertical door 13.

Hinge 11 may be made of many different materials. Galvanized steel of 11 to 18 gauge thickness is a typical material used to manufacture a hinge 11 of the type used with vertical garage doors for commercial and residential use. By way of non-limiting example only, a standard single barrel 33 hinge 11 may have a length of about 7.25 inches, a width of about 3.0625 inches, and a height of about 3.125 inches. Such hinge 11 width may represent the length dimension 37 of barrel 33. As can be appreciated, the outer edge surfaces of gussets 25, 27, 29, 31 are stiff and these parts and other parts of hinge 11 have the potential to damage any object in their path. While hinge cover 10 is described in connection with covering a hinge 11 of the type described herein, it should be understood that a hinge cover 10 may be configured to releasably couple to many different types of hinges besides hinge 11.

Referring next to FIGS. 4-16C, an embodiment of a hinge cover 10 capable of being removably attached to hinge 11, as well as other types of hinges, may include a body 57, a ramp 59, and a pair of opposed sidewalls 61, 63. Sidewalls 61, 63 may have inner surfaces 65, 67 and outer surfaces 69, 71. Side walls 61, 63 may extend in a common direction away from ramp 59.

In an embodiment, hinge cover 10 may include an axial connector 73 disposed along axis 75 to connect hinge cover 10 to hinge 11. Axial connector 73 may be removably insertable into and within barrel 33 through a respective end opening 43, 45 of barrel 33. Insertion of connector 73 into and within barrel 33 removably attaches hinge cover 10 to hinge 11 in the examples.

In embodiments, body 57 may be of a unitary type; in other words, body 57 may be a single part. Referring to FIGS. 4-9, body 57 may have the generalized appearance of a wedge. Body 57 may be of a polymeric material. For reasons of ease of manufacture and economy, body 57 may be made by means of plastic injection molding. Body 57 is not necessarily limited to a polymeric material and methods of manufacture other than injection molding may be utilized. For example, a body 57 embodiment could be made by a machining process.

Body 57 may be provided with a lower end 77 and an upper end 79. Ramp 59 may slope downwardly from upper end 79 toward lower end 77 to provide body 57 with the generalized wedge shape illustrated in FIGS. 4-9 and 11-16C. By way of non-limiting example, ramp 59 may be at an angle of from about 18° to about 50°. The purpose of the downwardly-sloped angle of ramp 59 is to provide for a more attenuated and gradual increase of force as ramp 59 comes into contact with a vehicle 83 bumper 85 or other object, thereby minimizing or eliminating any risk of damage.

Ramp 59 outer surface 81 is the part of hinge cover 10 expected to contact a vehicle 83 bumper 85 or other object.

Preferably, outer surface 81 is generally smooth which is useful to minimize any structural or cosmetic damage to the vehicle 83. Further, smooth outer surface 81 may be of a non-marring material to further minimize or eliminate any potential for cosmetic or other damage to vehicle 83 bumper 85 or another object.

Figure 11:
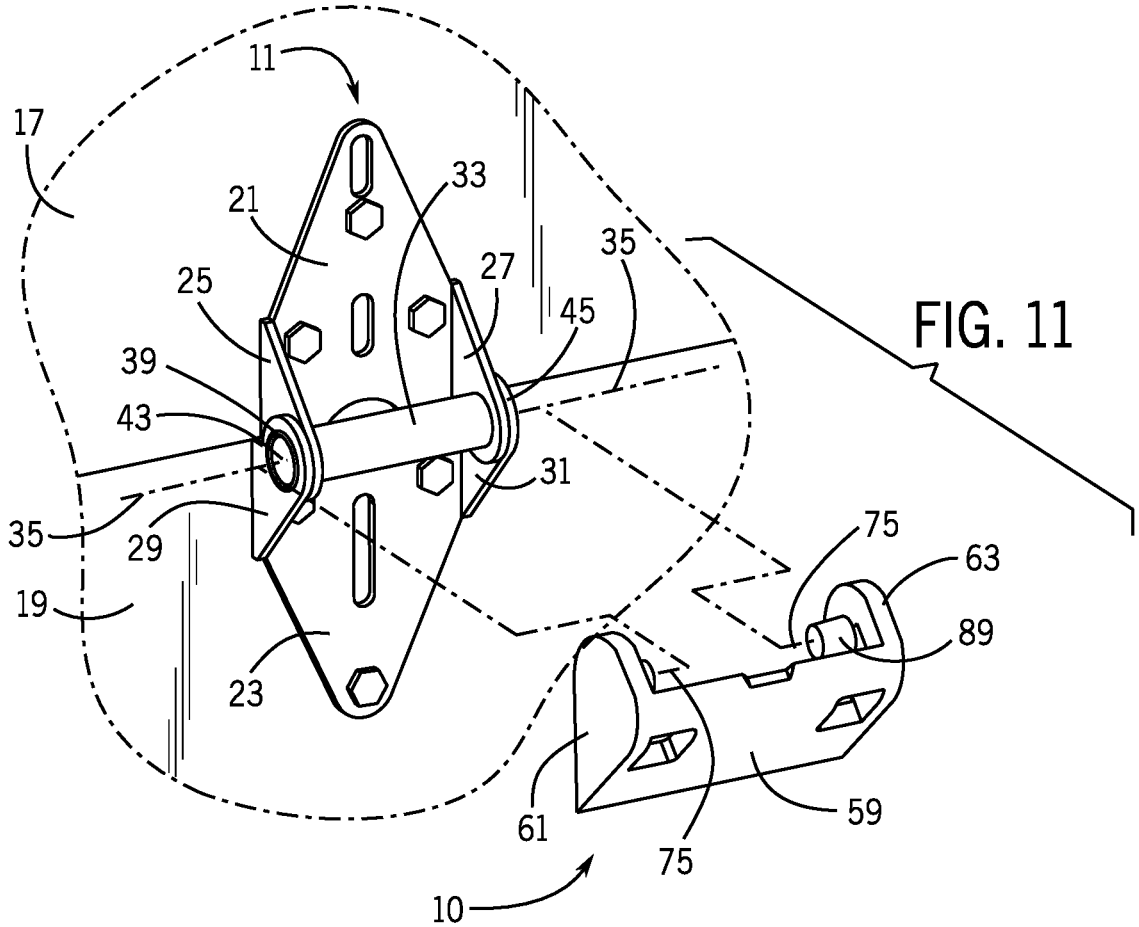
FIG. 11 is a view showing how the hinge cover of FIG. 4 may be removably attached to the hinge of FIG. 1.
Figure 12:
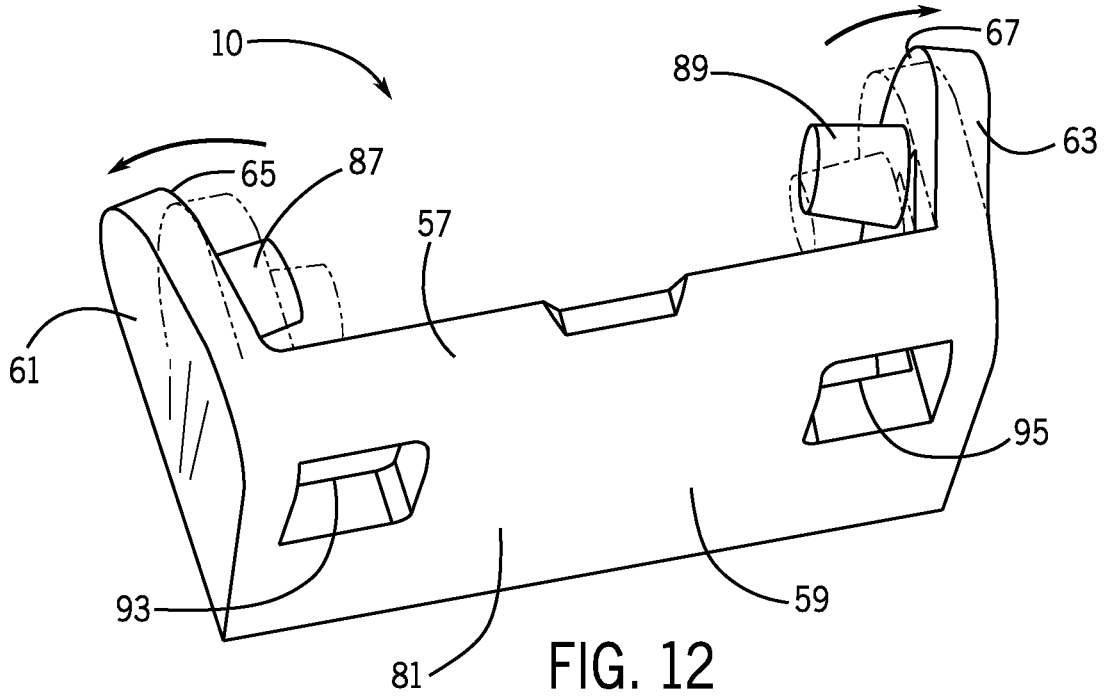
FIG. 12 is a view of the hinge cover of FIG. 4 with flexing of the sidewalls prior to attachment to the hinge of FIG. 1.
Figure 13:
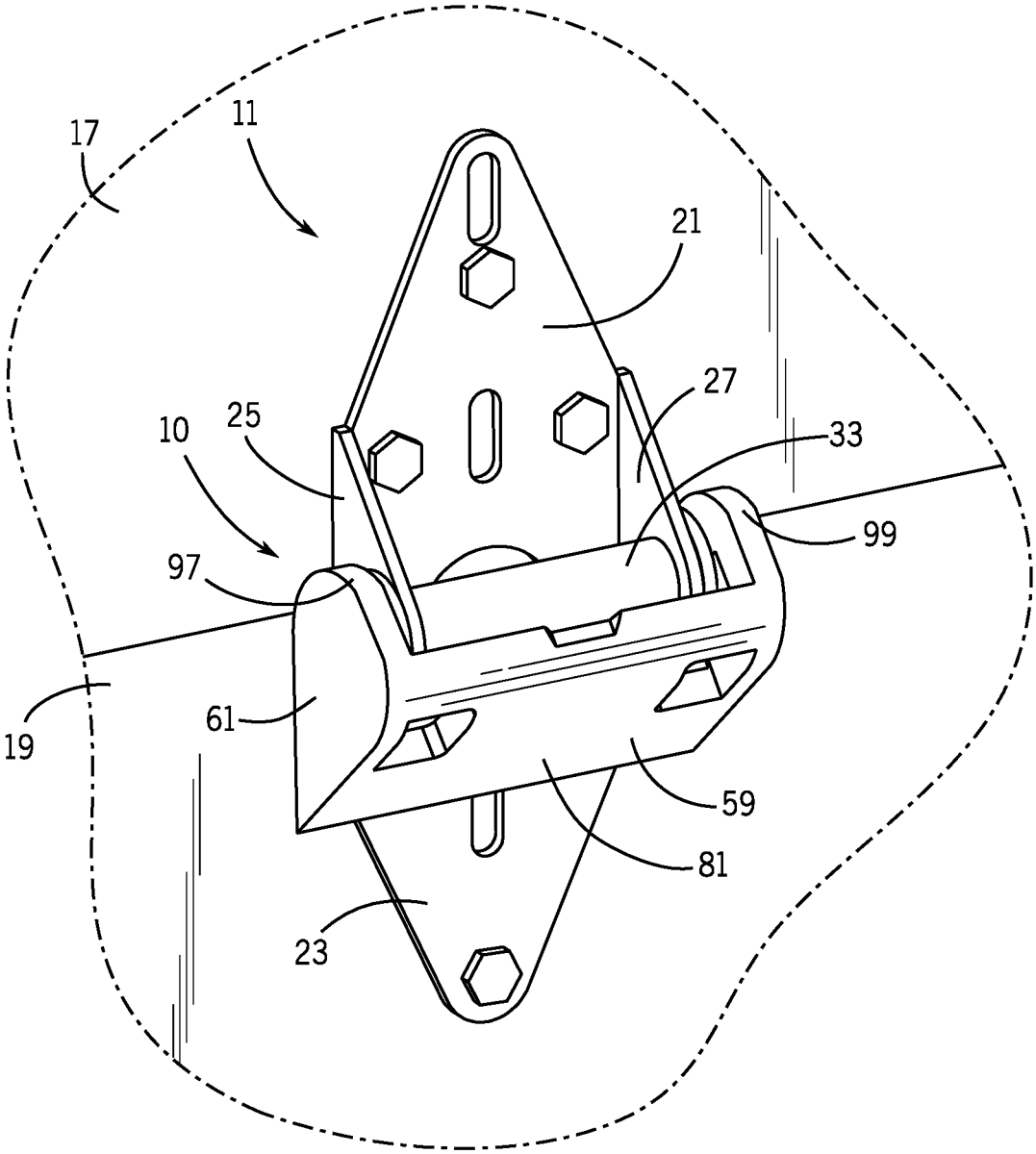
FIG. 13 is a view of the hinge cover removably attached to the hinge of FIG. 1.

Referring next to FIGS. 4-5 and 10-13, axial connector 73 may comprise a pair of inwardly-facing tabs 87, 89 coaxial with each other on axis 75 (FIG. 11) and generally coaxial with barrel axis 35 when hinge cover 10 is removably attached to hinge 11 as illustrated, for example, in FIGS. 11 and 13. Tabs 87, 89 may be formed in body 57 with a tab 87, 89 being on and extending away from a respective inner surface 65, 67 of a sidewall 61, 63 as illustrated in FIGS. 4-5 and 10-13. Sidewall inner surfaces 65, 67 may be spaced from one another sufficiently to fit over barrel 33 ends 39, 41 and to receive barrel 33 with its length dimension 37 therebetween. In embodiments, sidewall inner surfaces 65, 67 may be proximate barrel ends 39, 41 which may limit lateral movement of hinge cover 10 relative to hinge 11 and barrel 33.

In the examples, each tab 87, 89 may extend inward and toward the other tab 87, 89. Tabs 87, 89 may be spaced apart from the other for the purpose of connecting hinge cover 10 to hinge 11 as described in more detail herein.

Referring to FIGS. 11-12, sidewalls 61, 63 may be flexible. Sidewalls 61, 63 should be sufficiently rigid and robust to avoid substantial deformation and detachment of hinge cover 10 from hinge 11 when the hinge cover 10 contacts a vehicle 83 or other object. Sidewalls 61, 63 should be sufficiently flexible to allow a person to bend or flex the sidewalls 61, 63 away from one another, or outward, as indicated for example by the broken lines and arrows in FIG. 12. Flexing of sidewalls 61, 63 spaces tabs 87, 89 from one another to allow tabs 87, 89 to be inserted into barrel 33. The memory of the material used to make body 57 may return body 57 to its pre-flexed, original position enabling hinge cover 10 to be removably attached to hinge 11.

Hinge cover 10 is constructed in such a way that energy from a moving vertical door 13 may be dissipated into hinge cover 10 rather than into vehicle 83 bumper 85 or another object contacted by hinge cover 10. Flexure of tabs 87, 89 and sidewalls 61, 63 are thought to produce this result so that vertical door 13 movement against a vehicle 83 bumper 85 or other object may be stopped, or so that hinge cover 10 may ride over the vehicle 83 bumper 85 or other object without causing damage.

In such examples, tabs 87, 89 may be sized to fit into and within barrel 33 openings 43, 45. Insertion of male tabs 87, 89 into and within barrel 33 provides for a more positive removable connection of hinge cover 10 to hinge 11 as compared to a cover which might clip over barrel 33 and which could allow hinge cover 10 to be more easily detached from hinge 11 during operation. Further, male-type tabs 87, 89 are easy and simple to manufacture as compared with other types of more complex attachment structure, such as a female connector designed to clip over barrel 33. And, male-type tabs 87, 89 can be easily removed from within barrel 33 simply by spreading sidewalls 61, 63. In this manner, hinge cover 10 may be removed from hinge 11, thereby providing for a hinge cover 10 which is removably attachable with respect to hinge 11.

Tabs 87, 89 may have a frustoconical shape as illustrated in FIGS. 4-5, 10-12. If provided, the narrowed outer ends of tabs 87, 89 can make it easier for a person to insert tabs 87, 89 into openings 43, 45 of barrel 33 and to remove tabs 87, 89 from within barrel 33.

Body 57 may optionally include a pair of ports 93, 95. Ports 93, 95 may be entirely through body 57 and ramp 59 enabling a person to see tabs 87, 89 through body 57 to make it easier to fit tabs 87, 89 into openings 43, 45 at respective ends 39, 41 of barrel 33 during attachment of hinge cover 10 to hinge 11 and to see tabs 87, 89 removed from barrel 33 during detachment of hinge cover 10 from hinge 11.

Referring now to FIGS. 4-8, 11, 13, and 16A-16C, in certain embodiments hinge cover 10 may include structure to enable rotation of the hinge cover 10 about hinge 11 barrel 33. Rotation of hinge cover 10 can further minimize possible damage to the vehicle 83 or other object. In such embodiments, hinge cover 10 may include an outer edge 97, 99 along each sidewall 61, 63 and such outer edges 97, 99 may include a curvature or radius outward from axis 75 which may be substantially identical for each sidewall 61, 63. Each edge 97, 99 curvature or radius may enable hinge cover 10 to rotate upward about the coaxial tabs 87, 89 as will be explained in connection with FIGS. 16A-16C below.

Body 57 of hinge cover 10 may be made of one or more polymeric material. By way of non-limiting example, such polymeric material may yield a finished form hinge cover 10 having a durometer of about 40 to about 80 on the Shore A scale. A preferred durometer range of about 60 to about 70 on the Shore A scale may yield a body 57 with excellent flexibility yet minimal deformation properties so that hinge cover 10 will remain on hinge 11 during contact with a vehicle or other object and yet minimize force applied by the door which could damage the vehicle or other object.

By way of non-limiting examples, representative polymeric materials suitable for use in making a hinge cover 10 body 57 may include thermoplastic elastomers (TPE), flexible polyvinyl chloride (FPVC), and silicone rubber. Representative thermoplastic elastomers may include styrenic block copolymers, thermoplastic polyolefinelastomers, thermoplastic vulcanizates, thermoplastic polyurethanes, thermoplastic copolyesters, and thermoplastic polyamides.

Thermoplastic elastomers are sometimes referred to as thermoplastic rubbers. They are a class of copolymers or a physical mix of polymers (usually a plastic and a rubber) which consist of materials with both thermoplastic and elastomeric properties. Thermoplastics are relatively easy to use in manufacturing, for example, by injection molding. Thermoplastic elastomers show advantages typical of both rubbery materials and plastic materials. A benefit of using thermoplastic elastomers is the ability to stretch to moderate elongations and return to the original or near original shape (i.e., material memory). Thus, a body 57 of thermoplastic elastomers or like materials has a memory such that the body 57 may flex and yet retain its original shape as illustrated for example in FIGS. 11-13.

Use and operation of an example of a hinge cover 10 will now be described in connection with FIGS. 15A-15C and with FIGS. 16A-16C. Hinge cover 10 illustrated in the two examples of FIGS. 15A-16C has the same structure as illustrated and described in connection with FIGS. 4-14. In both operational examples, hinge 11, with its robust metal parts and metal part surfaces (e.g., gussets 25-31), would strike and damage any vehicle 83, bumper 85, or other object in the path of the hinge 11. Hinge cover 10 prevents any such damage as will now be described.

Figure 14:
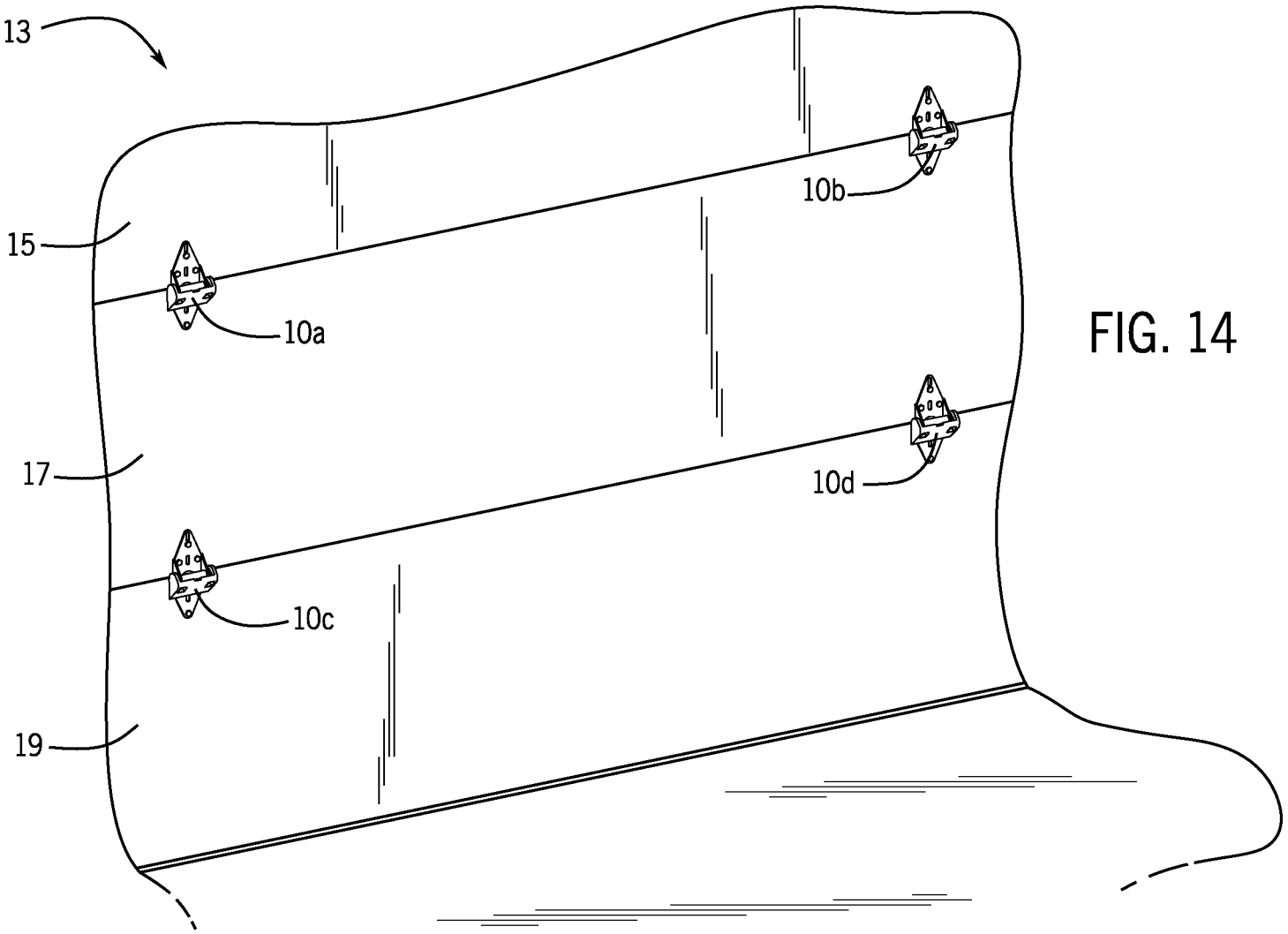
FIG. 14 is a perspective view of an inner surface of a vertical door, vertical door panels, and plural hinges each with a removably attached hinge cover.

In both operational examples, there is shown a vehicle 83 parked in a garage 101. Garage 101 may be any type of garage such as a residential or commercial garage. Garage 101 has an opening 103 which is opened and, alternatively, closed by a vertical door 13 (shown in cut-away view) consisting of articulated panels, three of which 15, 17, 19 are schematically illustrated in FIGS. 15A-16C. A hinge 11 of the type illustrated in FIGS. 1-3 joins panels 17, 19 together. Vertical door 13 with hinges 11 and hinge covers 10*a*-10*d* removably attached to each hinge 11 may be as illustrated in FIG. 14.

A conventional automatic vertical door opener (not shown) may optionally be used to raise and, alternatively, lower vertical door 13. As described previously, an automatic vertical door opener may include an electric motor which raises and, alternatively, lowers the vertical door 13. As is known, conventional automatic vertical door openers typically include a current-overload sensor which stops and reverses the downward movement of the vertical door 13 should the vertical door 13 contact an obstruction before completing its full range of downward travel.

Figure 15C:
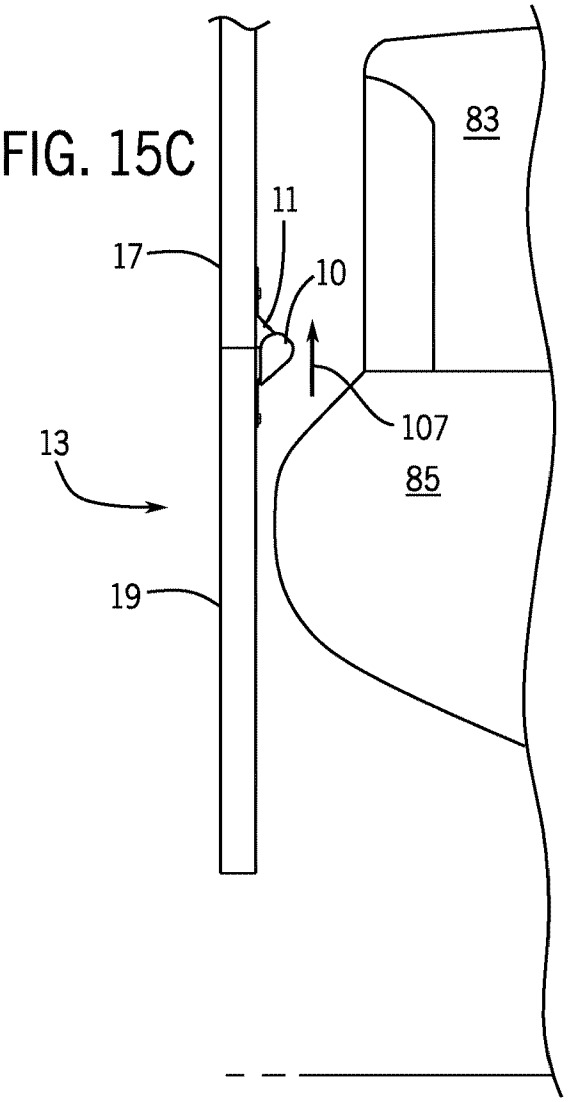
FIGS. 15A-15C are schematic side elevation views illustrating a first example in which the hinge cover of FIG. 4 provides protection for a vehicle bumper directly in the path of the hinge.
Figure 15B:
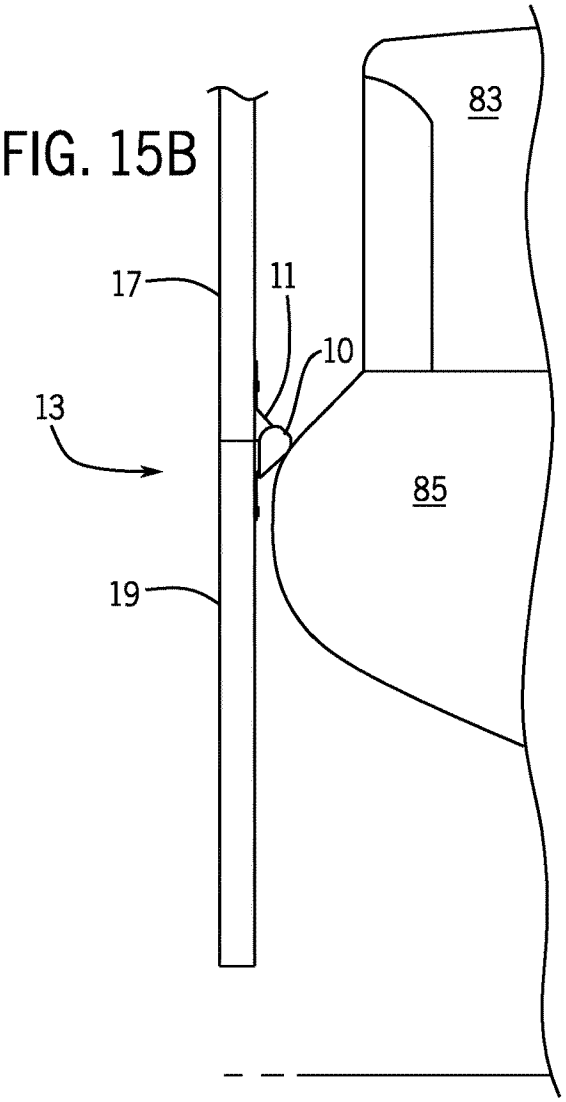
Figure 15A:
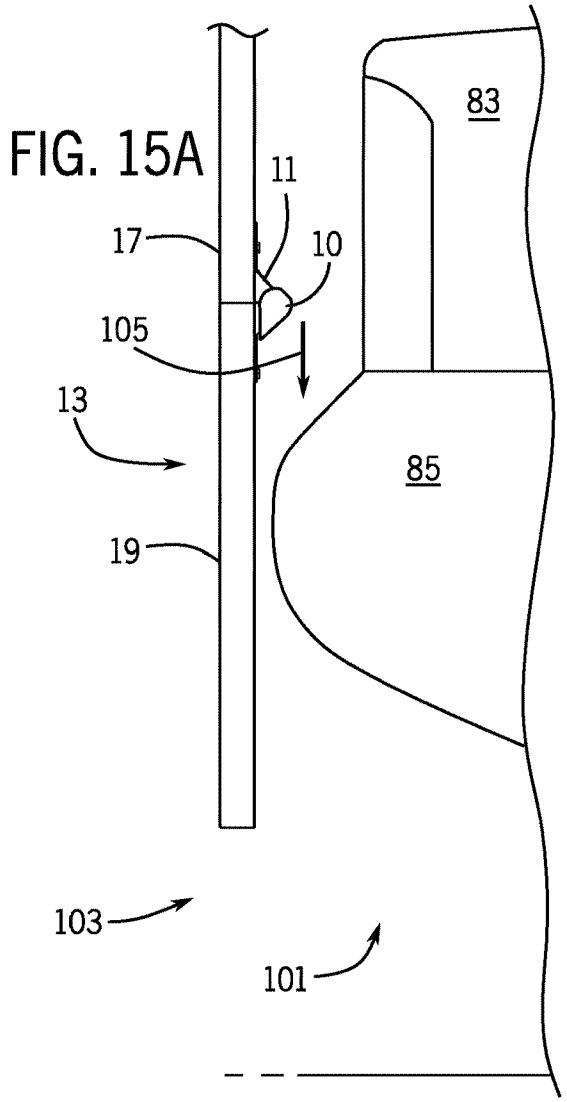

Referring then to FIGS. 15A-15C, the first operational example will be described. According to the first example, a vehicle 83 is parked in garage 101 with bumper 85 of vehicle 83 a first and very short distance from vertical door 13 and directly in the path of a hinge 11. The first distance may, for example, be just one inch from the inside surface 55 of vertical door 13. If uncovered, a hinge 11 having a height of about 3.125 inches would certainly scratch, mar, or otherwise damage bumper 85 or anything in its path during downward movement of vertical door 13.

Referring then to FIG. 15A, vertical door 13 is illustrated moving down under the influence of gravity and the automatic garage door opener (not shown) in the direction of arrow 105. Bumper 85 of vehicle 83 is spaced the first distance from vertical door 13 and is directly in the path of hinge 11, which is illustrated as being covered by hinge cover 10.

Referring next to FIG. 15B, hinge cover 10 is illustrated in a position in direct contact with bumper 85. Smooth outer surface 81 of downwardly-sloped ramp 59 of body 57, which is preferably non-marring, contacts bumper 85 and becomes wedged between vertical door 13 and bumper 83, each of which is in essentially a fixed position. The downwardly-sloped angle of ramp 59 of the generally wedge-shaped body 57 provides for a more attenuated and gradual increase of force as ramp 59 increasingly comes into contact with bumper 85, thereby minimizing any risk of damage to bumper 85. Tabs 87, 89 and side walls 61, 63 may flex to dissipate force applied by the downwardly descending vertical door 13 minimizing force applied to bumper 85 of vehicle 83 or any other object. In the example, such flexure of body 57 does not result in substantial deformation of body 57 so that body 57 remains removably attached to hinge 11. Eventually, resistance provided by hinge cover 10 between essentially fixed-position vertical door 13 and fixed-position bumper 85 stops downward movement of vertical door 13.

Referring lastly to FIG. 15C, stoppage of vertical door 13 by hinge cover 10 causes the current-overload sensor of the automatic door opener to reverse the motor and raise the vertical door 13 in the direction of arrow 107. The result is that bumper 85 is undamaged because of the protection provided by hinge cover 10.

Figure 16C:
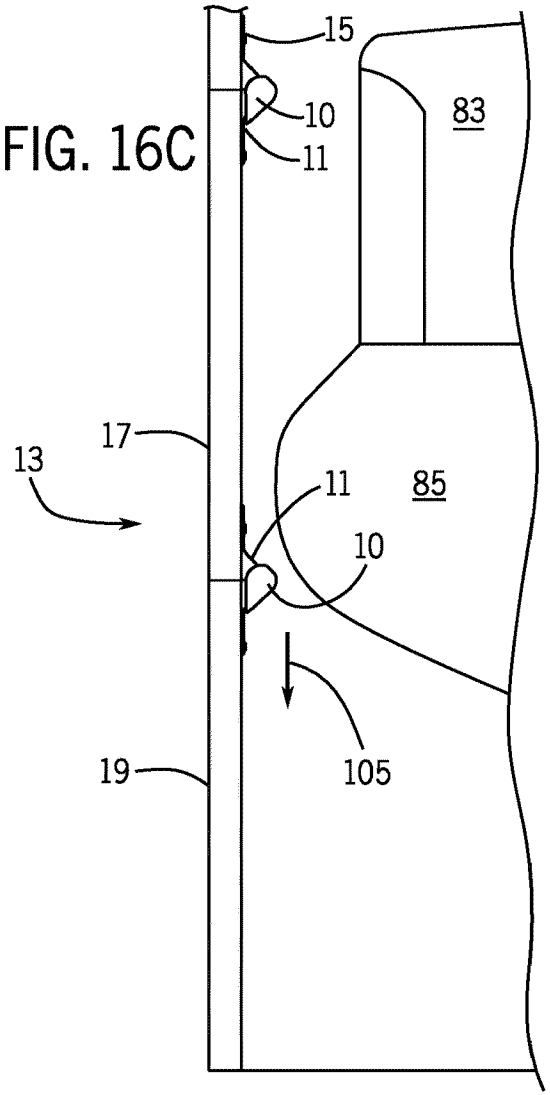
FIGS. 16A-16C are schematic side elevation views illustrating a second example in which the hinge cover of FIG. 4 provides protection for a vehicle bumper spaced further from the door than FIGS. 15A-15C, but still in the path of the hinge.
Figure 16B:
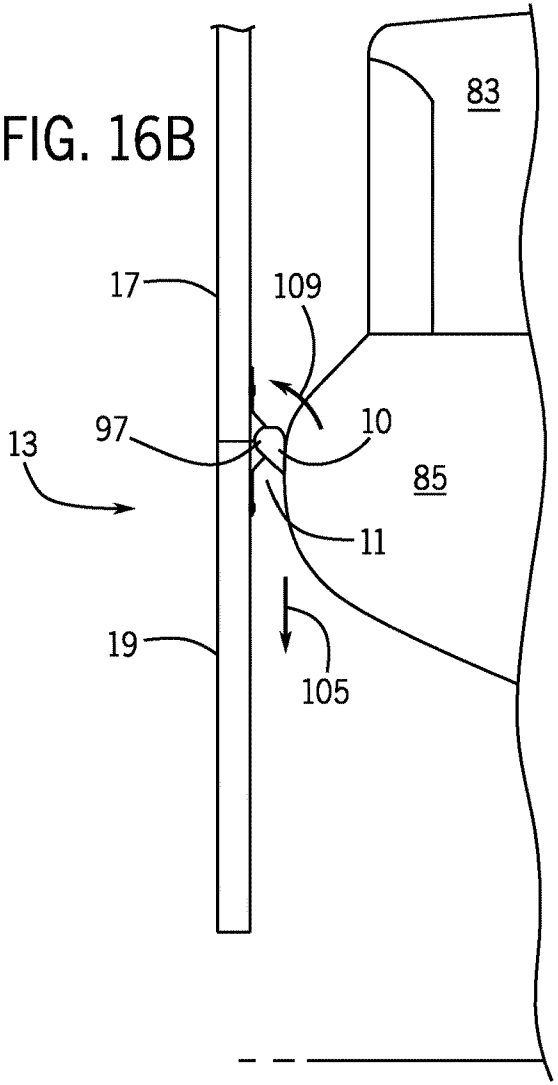
Figure 16A:
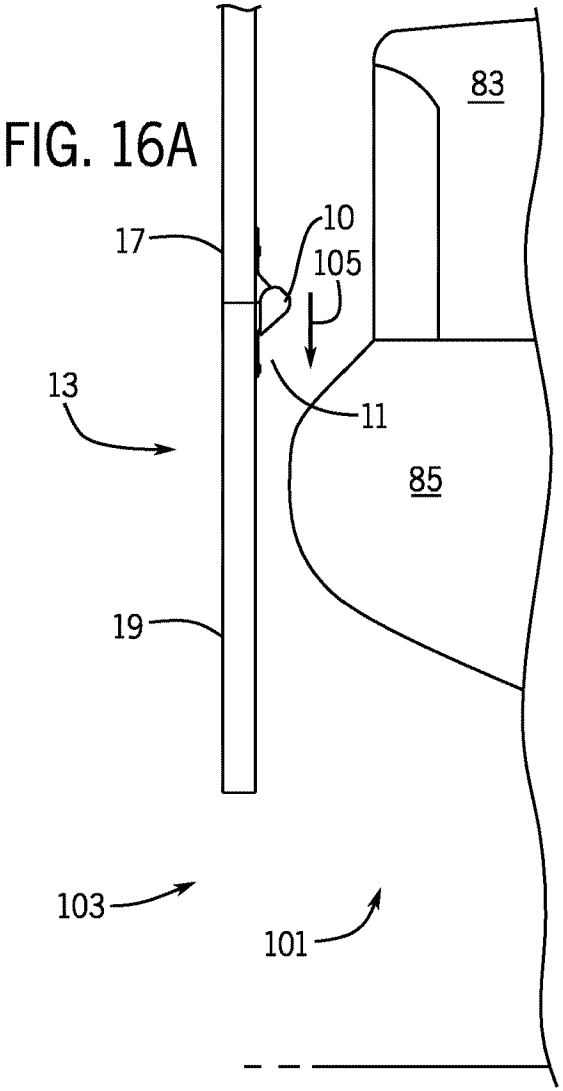

Referring next to the second operational example of FIGS. 16A-16C, vehicle 83 and bumper 85 are identical to that of FIGS. 15A-15C but bumper is spaced a second distance from vertical door 13. The second distance could be 3 inches from inner surface 55 which would be in the path of a hinge 11 having a height of about 3.125 inches to provide glancing contact with bumper 85 and thereby damage bumper 85 during downward movement of the vertical door 13.

In FIG. 16A, vertical door 13 is again illustrated moving down under the influence of gravity and the automatic garage door opener (not shown) in the direction of arrow 105. Bumper 85 is in the path of hinge 11 sufficiently for glancing contact with hinge 11 if there was no hinge cover 10.

Referring next to FIG. 16B, hinge cover 10 is illustrated in a position in glancing contact with bumper 85. In the example, the smooth outer surface 81 of ramp 59 (preferably a non-marring surface 81) is again the portion of body 57 which contacts bumper 85. The downwardly-sloped angle of the ramp 59 of the generally wedge-shaped body 57 again provides for a more attenuated and gradual increase of force as the ramp 59 carried on vertical door 13 (essentially in a fixed lateral position) comes into wedged contact with bumper 85, thereby minimizing any risk of damage to bumper 85. Tabs 87, 89 and side walls 61, 63 may once again flex to dissipate force applied by the downwardly descending vertical door 13.

In this example, hinge cover 10 glancingly contacts bumper 85 and may rotate in the direction of arrow 109 about barrel axis 35 and tab 87, 89 axis 75. In this example, curved outer surfaces 69, 71 can roll against vertical door 13 allowing hinge cover 10 to rotate and ride over bumper 85. Such rotation further eliminates or minimizes any possibility of damage to bumper 85.

Referring finally to FIG. 16C, the glancing and minimal contact between hinge cover 10 and bumper 85 is insufficient to trigger the current overload sensor of the automatic door opener. Consequently, vertical door 13 may continue down in the direction of arrow 105 until it completes travel until garage opening 103 is fully closed and automatic door opener is depowered. The result once again is that bumper 85 of vehicle 83 is undamaged because of the protection provided by hinge cover 10. If vertical door 13 is raised in the direction opposite arrow 105, the curvature of edges 97, 99 will contact bumper 85 and guide hinge cover 10 back over bumper 85 such that bumper 85 is not damaged by hinge 11 or hinge cover 10.

A further advantage of hinge cover 10 is that it will protect against damage should the vertical door 13 and hinge 11 be in a non-moving fixed position. For example, if a person walking past vertical door 13 was to contact a non-moving hinge 11, hinge cover 10 would prevent injury to the person or tearing of the person's clothing. And, if a moving vehicle 83 was to contact a non-moving hinge 11 for some accidental reason, hinge cover 10 would protect vehicle 83 from unwanted damage by hinge 11.

The foregoing description is provided for the purpose of explanation and is not to be construed as limiting the invention. While the invention has been described with reference to preferred embodiments or preferred methods, it is to be understood that the words which have been used herein are words of description and illustration, rather than words of limitation. Furthermore, although the invention has been described herein with reference to particular structure, methods, and embodiments, the invention is not intended to be limited to the particulars disclosed herein, as the invention extends to all structures, methods and uses that are within the scope of the appended claims. The disclosed hinge cover 10 may address some or all of the problems previously described. A particular embodiment need not address all of the problems described, and the claimed hinge cover 10 should not be limited to embodiments comprising solutions to all of these problems. Further, several advantages have been described that flow from the structure and methods; the present invention is not limited to structure and methods that encompass any or all of these advantages. Those skilled in the relevant art, having the benefit of the teachings of this specification, may effect numerous modifications to the invention as described herein, and changes can be made without departing from the scope and spirit of the invention as defined by the appended claims. Furthermore, any features of one described embodiment can be applicable to the other embodiments described herein.

What is claimed is:

1. A hinge cover removably attachable to a hinge for a vertical door, the hinge including leaves connected together by an axial barrel with opposite ends defining openings, the hinge cover comprising:

a generally wedge-shaped unitary body of polymeric material including a downwardly-sloping ramp and a pair of opposed flexible sidewalls extending in the same direction away from the ramp, the sidewalls having opposed inner surfaces spaced from one another sufficiently to receive the barrel therebetween; and an axial connector comprising a pair of inwardly-facing coaxial tabs in the body, a tab being on each of the opposed inner sidewall surfaces and extending away from the respective sidewall inner surface, the tabs being removably insertable in a respective barrel end opening with by outward flexing of the sidewalls to thereby removably attach the hinge cover to the hinge.

2. The hinge cover of claim 1 wherein each tab is generally coaxial with a barrel axis when in the respective barrel opening.

3. The hinge cover of claim 2 wherein each tab has a frustoconical shape with a narrowed outer end.

4. The hinge cover of claim 2 wherein the body has a lower end, an upper end, and the ramp slopes downwardly toward the lower end.

5. The hinge cover of claim 4 wherein the ramp has a smooth outer surface.

6. The hinge cover of claim 2 wherein each sidewall has an outer edge and the edge includes a curvature which is substantially identical for each sidewall, wherein the edge radius enables the hinge cover to rotate upward about the coaxial tabs.

7. The hinge cover of claim 2 wherein the barrel has a length dimension and each sidewall of the hinge cover is spaced from the other sufficiently such that each sidewall inner surface is proximate an end of the barrel when the hinge cover is removably attached to the hinge.

8. The hinge cover of claim 2 wherein the polymeric material has a durometer of about 40 to about 80 on the Shore A scale.

9. The hinge cover of claim 8 wherein the polymeric material is selected from the group consisting of thermoplastic elastomer, flexible polyvinyl chloride, and silicone rubber.

10. The hinge cover of claim 9 wherein the thermoplastic elastomer is selected from the group consisting of styrenic block copolymer, thermoplastic polyolefinelastomer, thermoplastic vulcanizate, thermoplastic polyurethane, thermoplastic copolyester, and thermoplastic polyamide.

11. A hinge cover removably attachable to a hinge for a vertical door, the hinge including leaves connected by an axial barrel with opposite ends defining openings, the hinge cover comprising:

a generally wedge-shaped unitary body;

a downwardly-sloping ramp in the body;

a pair of opposed flexible sidewalls in the body joined to the ramp and extending in a common direction away from the ramp, the sidewalls having opposed inner surfaces and also having outer surfaces; and a pair of inwardly-facing coaxial tabs in the body for removably attaching the cover to the hinge, a tab being on each of the opposed inner sidewall surfaces and extending away from the respective sidewall inner surface, wherein the sidewalls may be flexed to enable insertion of the tabs in a respective barrel end opening to removably attach the hinge cover to the hinge.

12. The hinge cover of claim 11 wherein the body has a lower end, an upper end, and the ramp slopes downwardly toward the lower end.

13. The hinge cover of claim 12 wherein the ramp has a smooth outer surface.

14. The hinge cover of claim 12 wherein each sidewall has an outer edge and the edge includes a curvature which is substantially identical for each sidewall, wherein the edge radius enables the hinge cover to rotate upward about the coaxial tabs.

15. The hinge cover of claim 12 wherein the barrel has a length dimension and each sidewall of the hinge cover is spaced from the other sufficiently such that each sidewall inner surface is proximate an end of the barrel when the hinge cover is removably attached to the hinge.

16. The hinge cover of claim 12 wherein the body is of polymeric material.

17. The hinge cover of claim 16 wherein the polymeric material has a durometer of about 40 to about 80 on the Shore A scale.

18. The hinge cover of claim 17 wherein the polymeric material is selected from the group consisting of thermoplastic elastomer, flexible polyvinyl chloride, and silicone rubber.

19. The hinge cover of claim 18 wherein the thermoplastic elastomer is selected from the group consisting of styrenic block copolymer, thermoplastic polyolefinelastomer, thermoplastic vulcanizate, thermoplastic polyurethane, thermoplastic copolyester, and thermoplastic polyamide.

* * * * *